US006100003A

United States Patent [19]

Snelling et al.

[11] Patent Number: 6,100,003

[45] Date of Patent: Aug. 8, 2000

[54] ACOUSTIC INK MIST COLOR DEVELOPMENT

[75] Inventors: Christopher Snelling, East Rochester; Dale R. Mashtare, Palmyra, both of N.Y.

[73] Assignee: Xerox Corporation, Stamford, Conn.

[21] Appl. No.: 09/360,669

[22] Filed: Jul. 26, 1999

[51] Int. Cl.[7] ..... G03G 15/10; G03G 9/16

[52] U.S. Cl. ..... 430/137; 430/45

[58] Field of Search ..... 430/45, 137; 399/116, 399/241

[56] References Cited

U.S. PATENT DOCUMENTS 2,690,394 9/1954 Carlson ..... 399/116
3,795,443 3/1974 Heine-Geldern et al. ..... 355/10
5,752,142 5/1998 Staples et al. ..... 399/241

FOREIGN PATENT DOCUMENTS

WO 95/10800 4/1995 WIPO .

*Primary Examiner*—John Goodrow
*Attorney, Agent, or Firm*—William A. Henry, II

[57] ABSTRACT

A method that enhances safety while producing toners that are $\leqq 5\mu$ to be used in developing an electrostatic image includes providing selectable color toner liquids on demand to a mixing station; mixing the provided color toner liquids at the mixing station; producing a mist from the mixed toner liquid; collecting color toner particles resulting from the mist cooling; depositing the color toner particles in a development sump that includes carrier beads; and mixing the color toner particles with the carrier beads to produce two-component developer.

2 Claims, 3 Drawing Sheets

ACOUSTIC INK MIST COLOR DEVELOPMENT

Cross-reference is hereby made to copending and commonly assigned U.S. patent application Ser. No. 09/360,671, filed on Jul. 26, 1999, allowed and entitled Acoustic Ink Mist Non-Interactive Development by Christopher Snelling et al.

BACKGROUND OF THE INVENTION

1. Field of the Invention

This invention relates to a method and apparatus for developing electrostatic images, and more particularly, to developing the images with small toner particles safely.

2. Description of the Prior Art

Various development systems are known in the art of developing electrostatic images including cascade, powder cloud, liquid, magnetic brush, and the like, each of which employs electroscopic working particles that are preferably charged to a polarity. The charged particles are presented to the latent images to develop them. One common drawback of many of the heretofore-mentioned development systems is dust, which further requires mechanisms and systems to contain the dust.

In U.S. Pat. No. 2,690,394 to Carlson issued Sep. 28, 1954, there is described a system of electrostatic imaging which utilizes an atomizer to produce a spray of droplets to a solvent. The droplets of solvent are charged by an electrode and then are drawn by means of a suction pump over a recording surface including an electrostatic image. Droplets of solvent are attracted by the oppositely charged image and deposited on the recording surface. The solvent is then transferred from the recording member to a sheet of paper and the paper then passes over a dye-coated roller so that some of the dye is dissolved onto the paper to produce an image. Solvents proposed include high boiling point alcohols, cellosolve, toluene, cyclohexanol acetate and alcohol-water mixtures. It is also suggested that mixtures of solvent with an ink or dye can be atomized and also that the solvent can contain suspended pigments and binders. There is no disclosure, however, of a liquid system where the liquid is composed primarily of water.

It has been disclosed in Heine-Geldern et al., U.S. Pat. No. 3,795,443, issued Mar. 5, 1974, that some liquids are not always characterized as being electrically resistive when generated into a fine mist in the vicinity of an electrostatic charge pattern and will deposit selectively onto an electrostatic image. By chemically coloring the liquid, as by dyes and pigments the selective deposition produces an image reproduction which optionally can subsequently be transferred from or fixed directly on the image bearing surface. The development of this means is effected without using a carrier. Such a system experiences difficulty in developing solid areas without the benefit of external control means such as a development electrode.

Such methods as disclosed by Heine-Geldern et al., are characterized by inadequate development of the electrostatic image by mists such as ultrasonically generated liquid mists. Typically, only small amounts of colorant, be it dye stuff or pigment, deposit onto an electrostatic image on the recording member, be it a photoconductor or dielectric, in a reasonable time, with respect to a practical device for office or industrial reproduction. Thus, commercialization of such an apparatus, as disclosed in Heine-Geldern et al. and Carlson is seen as difficult with regard to the excessively long time that is required for developing of the latent image, not withstanding the low quantity of coloring material which as a result is deposited onto the recording member during such time.

Indoor air quality in offices and other areas where electrostatic image development is used can be seriously affected by hydrocarbon solvents which characterize many liquid development systems and dust which characterizes many powder development systems. There is considerable advantage if an electrostatic image development system could be provided which uses water as the main carrier rather than a hydrocarbon solvent. Such a system is disclosed in an International Application published under the PCT as WO 95/10800. All of the heretofore-mentioned references are incorporated herein by reference to the extent necessary to practice the present invention.

However, there is still a need for an electrostatic image development system that can accommodate custom color on demand and to provide safety from hazards associated with the manufacture, packaging, distribution and machine installation of ultra small toners sized less than $5\mu$.

SUMMARY OF THE INVENTION

Accordingly, a method is provided that enhances safety while producing toners that are $\leqq 5\mu$ to be used in developing an electrostatic image, and comprises the steps of: providing selectable color toner liquids on demand to a mixing station; mixing the provided color toner liquids at the mixing station; providing a mist from the mixed toner liquid; collecting color toner particles resulting from the mist cooling; depositing the color toner particles in a development sump that includes carrier beads; and mixing the color particles and carrier beads to produce two-component developer.

DETAILED DESCRIPTION OF THE PREFERRED EMBODIMENTS

Figure 1:
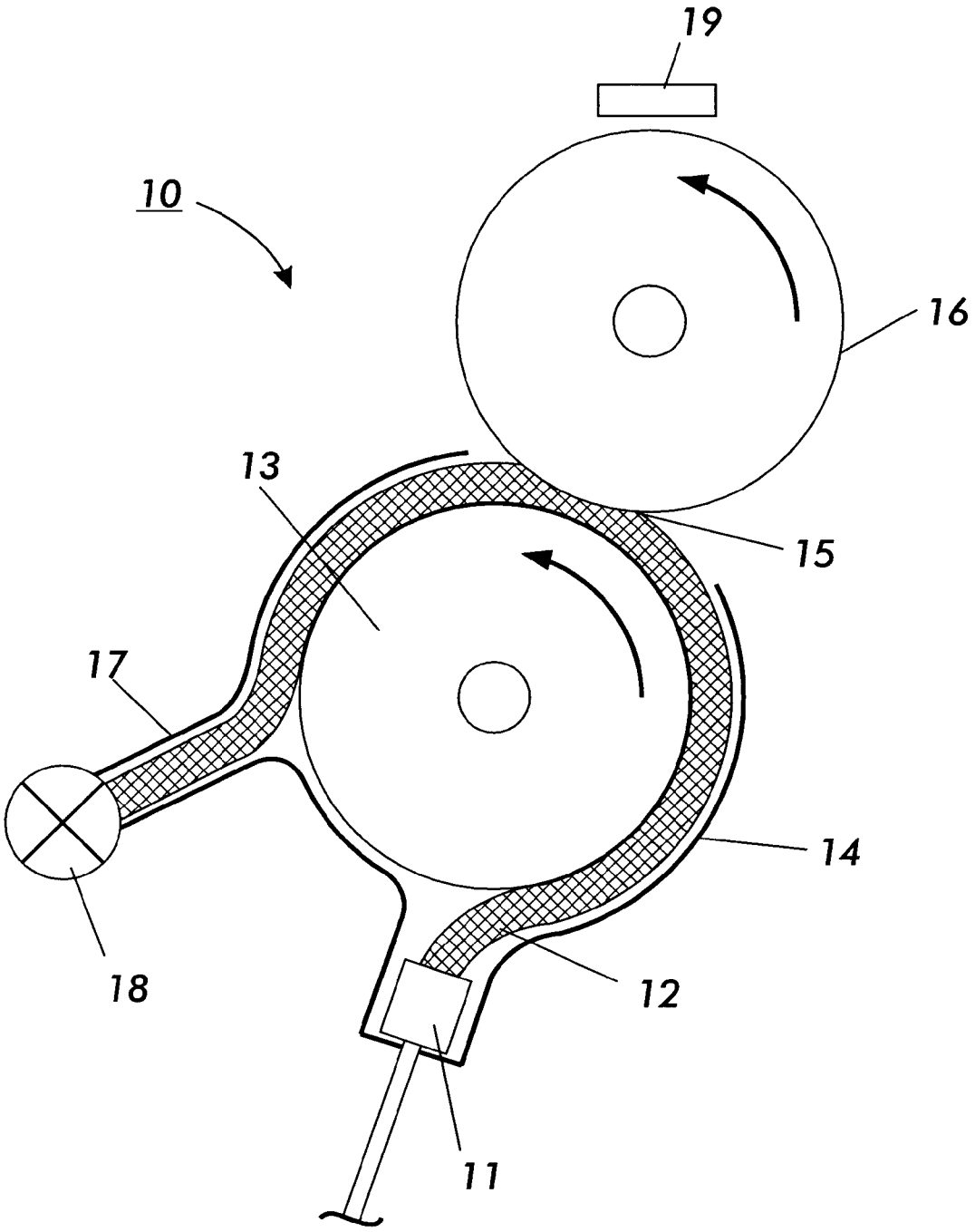
FIG. 1 PRIOR ART
FIG. 1 is a prior art embodiment in schematic form that shows positioning of various components of an electrostatic imaging apparatus that can be used in implementing the present invention.

A prior art apparatus 10 for developing an electrostatic image with a liquid mist is shown in FIG. 1 and includes a water mist generation device 11 adapted to direct mist into the arcuate space 12 between a development drum 13 and a shroud 14. The development drum 13 is adapted to rotate as indicated by the arrow so as to draw the mist around in the arcuate paths. The mist is transported to a development station 15, which is the region of nearest proximity between the development drum 13 and a recording drum 16. Unused mist is carried further around the development drum to an extraction duct 17. An extraction fan 18 enhances extraction of unused mist. The mist may be condensed and the waste liquid passed to storage (not shown) or recycled to the water mist generation device. The recording drum may have a recording member on its surface upon which an electrostatic image is produced at imaging station 19 and which is then rotated in the direction of the arrow to the development station for instantaneous development of the image. The imaging station 19 may include means to charge the recording member and form the required electric charge pattern as is well known in the art. Deposited image fixing or subsequent transferal of the image (not shown) after the development station will be understood by the skilled in the art.

Figure 2:
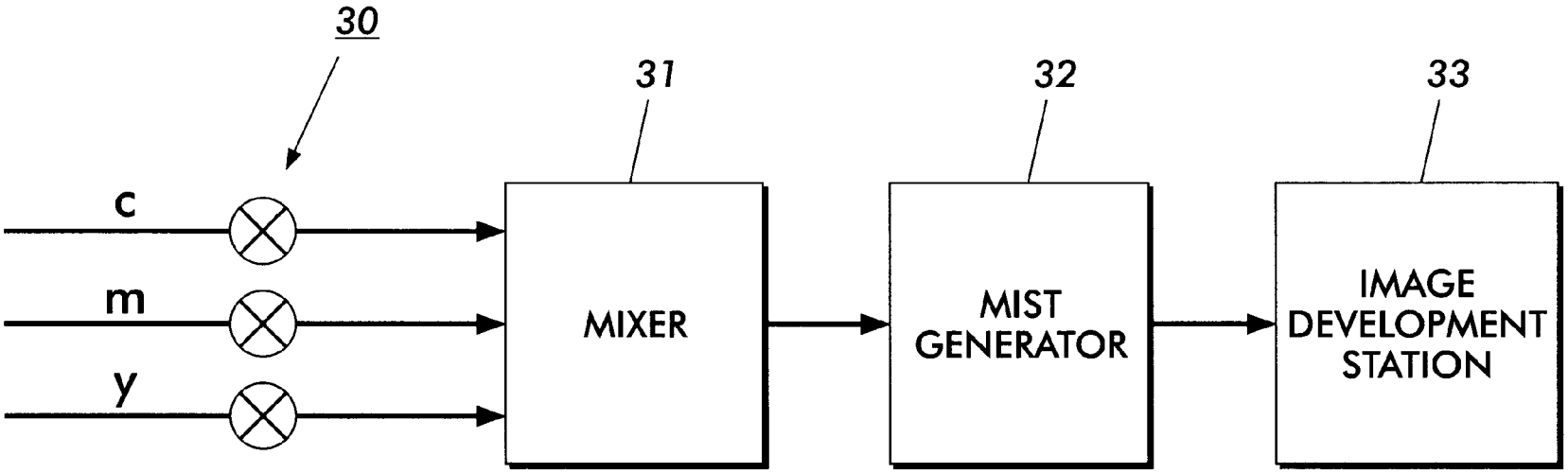
FIG. 2 is a schematic showing an embodiment of the present invention for producing custom color images.

In order to provide a custom color option to satisfy a particular machine operator, an improvement to the development apparatus and method of FIG. 1 is shown in FIG. 2 that comprises valved sources 30 of cyan (c) magenta (m) and yellow (y) toner inks that are supplied to a conventional mixing unit 31 where the inks are mixed to produce a desired color. The mixed color is then passed to a mist creating station where ultrasonic mist generation device 32 is used to turn the water based liquid inks into a mist. The resultant mist is used to develop an electrostatic image at station 33. Thereafter, the developed image can be conventionally transferred to a copy sheet and fixed to the copy sheet (not shown) as is known by those skilled in the art.

Figure 3:
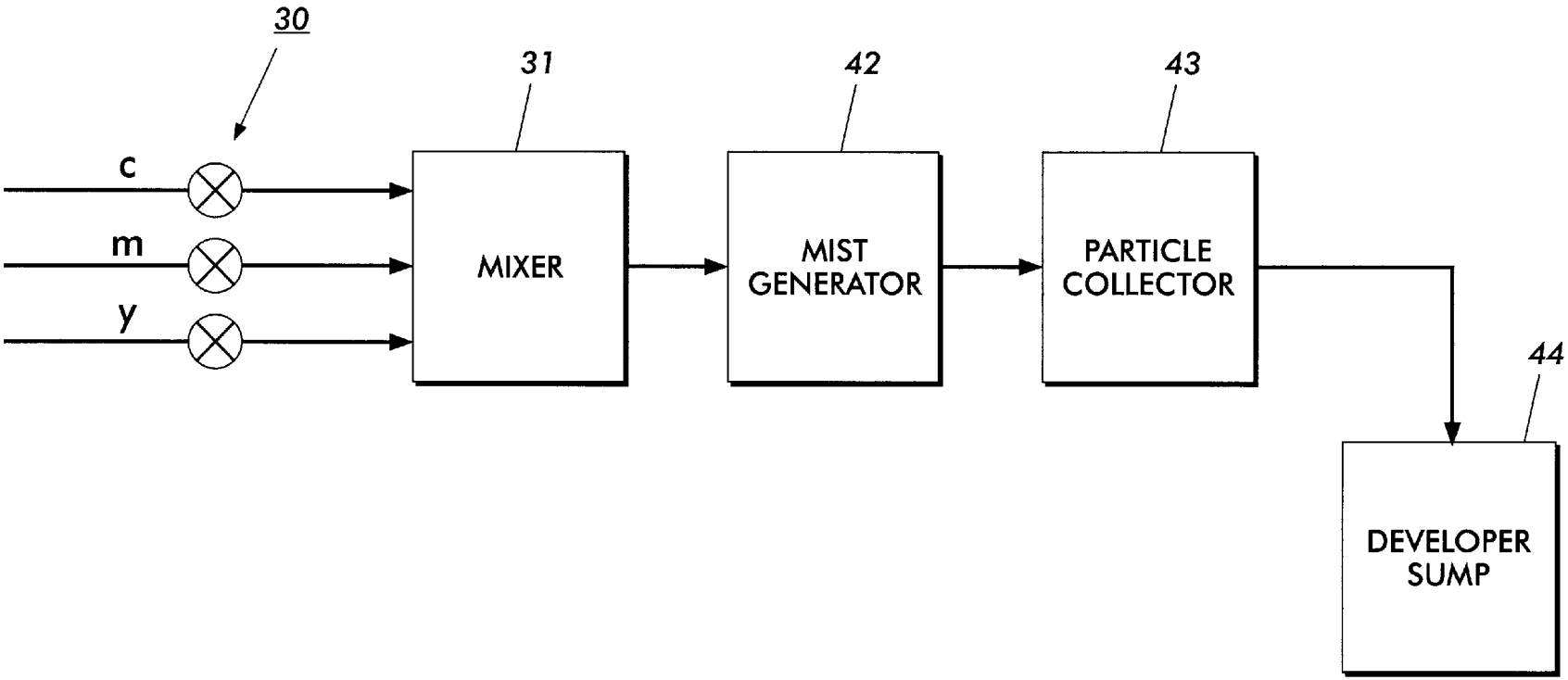
FIG. 3 is a schematic of an embodiment of the present invention that facilitates the creation of toner particles on demand while minimizing operator exposure to ultra small toner particles.

In FIG. 3 a method for creating toner in real time within a machine that provides safety when developing images with ultra small toners of a size of $\leqq 5\mu$ is disclosed and comprises valved sources 30 of hot melt inks including cyan, magenta and yellow that are forwarded on demand to a mixing unit 31. The mixing unit mixes the hot melt toner inks and forwards the toner ink mix to mist generating station 42 where a device such as a heated ultrasonic transducer turns the ink mix into a mist. Particles from the mist are collected at by particle collector 43 which cools the mist and the resultant particles formed thereby being forwarded to a development sump 44 where the particles are conventionally mixed with carrier beads with the carrier beads and toner being subsequently used to conventionally develop an electrostatic image.

The acoustic ink mist image development process of the present invention has been achieved using hot melt ink jet materials normally used in the Textronix Phaser III Printer. Number TKTX-1485D magenta ink was melted on the heated tip of a Bronson KET-1 hand held 40 Khz ultrasonic welding horn. The horn tip had been heated with a hot air gun (Master Appliance Co. Model HG301B). Upon ultrasonic activation of the horn the liquid ink dramatically converted to a mist of particles. An electrostatic latent image created by stencil charging of a 1 mil Mylar receptor was acoustic ink developed by placing it near the activated horn tip.

Also, the process of creating small ($\leqq 5\mu$) toner particles within an imaging system as shown in FIG. 3, was demonstrated by creating particles from hot melt ink jet materials using a heated Bronson KET-1 hand held 40 Khz ultrasonic welding horn with the created particles being harvested and mixed with carrier used in the Xerox 2510 copier to constitute a two-component developer material. Approximately 300 mgs of toner particles was gently mixed with 22 mgs of carrier. Cascade development of stencil charged 1 mil aluminized Mylar was accomplished. Tribo charging of the particles to a positive polarity was indicated by their ability to develop negative charge polarity images.

It should now be understood that a method has been disclosed that allows custom color to be accomplished in an electrostatic imaging apparatus by mixing colors to give the desired color before the mixed color is turned into a mist. A method is also disclosed that avoids the safety concerns, i.e., the possibility of inhaling some of the toner particles associated with manufacture, packaging, distribution and installation of ultra small toners in machines by incorporating means for generating the toner particles within the xerographic marking system itself.

While the embodiments shown herein are preferred, it will be appreciated that these are merely examples, and that various alternatives, modifications, variations or improvements thereon may be made by those skilled in the art from the teaching which is intended to be encompassed by the following claims:

What is claimed is:

1. A method of providing custom color to an image development station for development of electrostatic images, comprising the steps of:

providing a toner ink mixing station;

providing selectable color toner inks on demand to said mixing station;

mixing said provided color toner inks at said mixing station;

producing a mist from said mixed color toner inks;

providing a particle collector for cooling said toner mist and collecting resulting color toner particles;

providing a developer sump having carrier beads therein;

transporting said color toner particles to said developer sump; and mixing said color toner particles and said developer beads to produce a two-component developer.

2. A method for supplying custom color in an image development system, comprising the steps of: providing selectable color, hot melt, water based toner liquids on demand to a mixing station; mixing the provided color toner liquids at said mixing station; providing a mist from the mixed toner liquid; providing a particle collecting station for collecting and cooling the mist to provide color toner particles; providing a developer sump with carrier beads therein; transporting the color toner particles to said developer sump; and mixing said color toner particles with the carrier beads in said developer sump to provide a two-component developer.

* * * * *